US011834923B2

(12) United States Patent
Kelley et al.

(10) Patent No.: US 11,834,923 B2
(45) Date of Patent: Dec. 5, 2023

(54) HIGH PRESSURE SWELLABLE PACKER

(71) Applicant: TAM INTERNATIONAL, INC., Houston, TX (US)

(72) Inventors: Caleb Kelley, Houston, TX (US); John Thurston, Houston, TX (US)

(73) Assignee: TAM INTERNATIONAL, INC., Houston, TX (US)

( * ) Notice: Subject to any disclaimer, the term of this patent is extended or adjusted under 35 U.S.C. 154(b) by 0 days.

(21) Appl. No.: 18/169,506

(22) Filed: Feb. 15, 2023

(65) Prior Publication Data

US 2023/0258050 A1 Aug. 17, 2023

Related U.S. Application Data

(60) Provisional application No. 63/311,371, filed on Feb. 17, 2022.

(51) Int. Cl.
*E21B 33/12* (2006.01)

(52) U.S. Cl.
CPC ..... *E21B 33/1212* (2013.01)

(58) Field of Classification Search
CPC ..... E21B 33/1212
See application file for complete search history.

(56) References Cited

U.S. PATENT DOCUMENTS

| | | | | |
|---|---|---|---|---|
| 7,662,471 | B2 * | 2/2010 | Pudleiner | G02B 5/0242 428/323 |
| 7,963,321 | B2 * | 6/2011 | Kutac | E21B 33/1216 166/187 |
| 8,151,894 | B2 * | 4/2012 | Nutley | E21B 17/1028 166/207 |
| 8,997,854 | B2 * | 4/2015 | Lembcke | E21B 33/129 166/134 |
| 9,725,976 | B2 * | 8/2017 | Loginov | E21B 23/04 |
| 9,732,581 | B2 * | 8/2017 | Morehead | E21B 33/12 |

* cited by examiner

*Primary Examiner* — Nicole Coy
(74) *Attorney, Agent, or Firm* — Ewing & Jones, PLLC

(57) ABSTRACT

A packer includes a tubular mandrel. The packer includes a first end cap, the first end cap coupled to the mandrel. The packer includes a backup mechanism coupled to the first end cap. The packer includes a swellable elastomeric body positioned about the mandrel abutting the first end cap. The swellable elastomeric body is positioned at least partially between the mandrel and the backup mechanism. The swellable elastomeric body is positioned to not cover the entire outer surface of the backup mechanism.

15 Claims, 6 Drawing Sheets

HIGH PRESSURE SWELLABLE PACKER

This application is a nonprovisional application which claims priority from U.S. provisional application No. 63/311,371, filed Feb. 17, 2022, which is incorporated by reference herein in its entirety.

TECHNICAL FIELD/FIELD OF THE DISCLOSURE

The present disclosure relates generally to downhole isolation tools, and specifically to swellable packers.

BACKGROUND OF THE DISCLOSURE

Swellable packers are isolation devices used in a downhole wellbore to seal the inside of the wellbore or a downhole tubular that rely on elastomers to expand and form an annular seal when immersed in certain wellbore fluids. Typically, elastomers used in swellable packers are either oil- or water-sensitive. Various types of swellable packers have been devised, including packers that are fixed to the OD of a tubular and the elastomer formed by wrapped layers, and designs wherein the swellable packer is slipped over the tubular and locked in place.

SUMMARY

The present disclosure provides for a packer. The packer may include a tubular mandrel. The packer may include a first end cap, the first end cap coupled to the mandrel. The packer may include a backup mechanism coupled to the first end cap. The packer may include a swellable elastomeric body positioned about the mandrel abutting the first end cap. The swellable elastomeric body may be positioned at least partially between the mandrel and the backup mechanism. The swellable elastomeric body may be positioned to not cover the entire outer surface of the backup mechanism.

The present disclosure also provides for a method. The method may include providing a mandrel, the mandrel being tubular. The method may include applying a bonding agent to a portion of the surface of the mandrel. The method may include applying swellable elastomer to the mandrel. The method may include securing an end cap and backup mechanism to the mandrel, the end cap positioned at an end of the swellable elastomer, the backup mechanism extending along the outer surface of the swellable elastomer.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
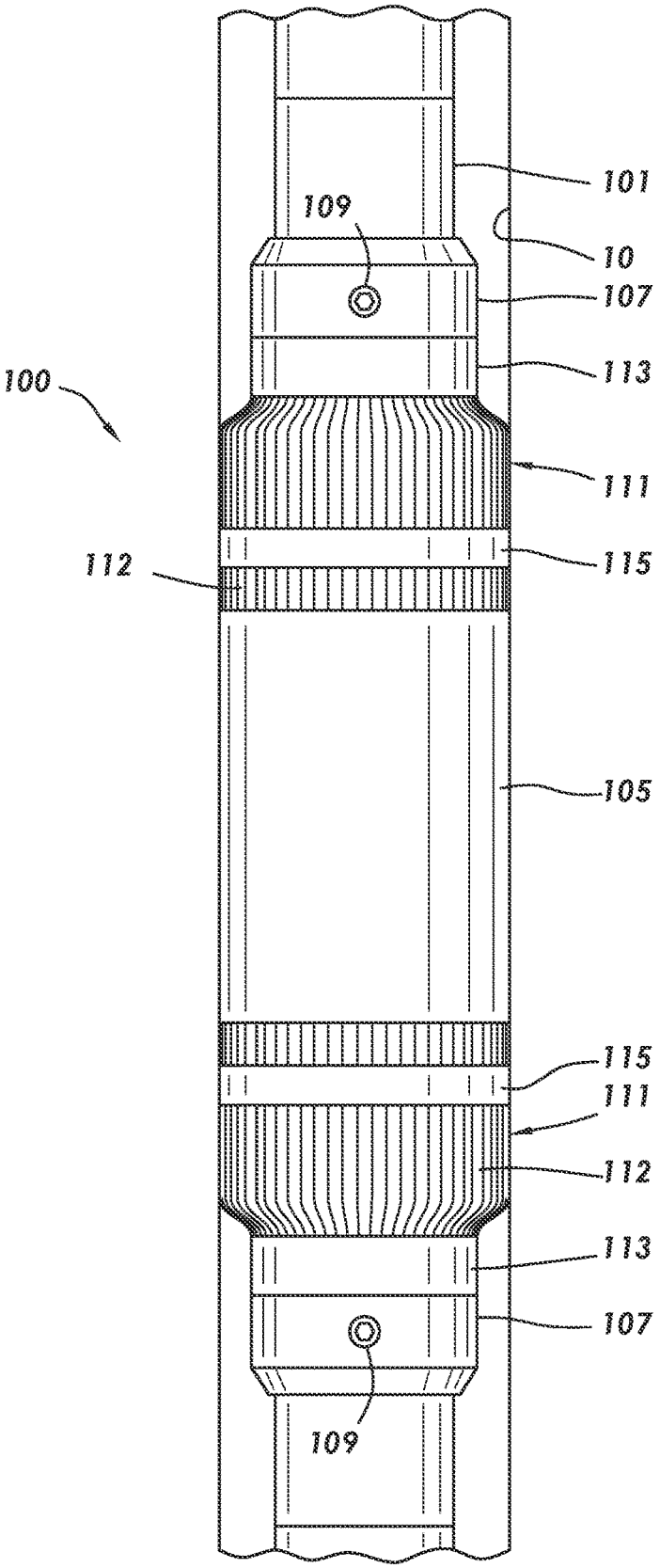
FIG. 1 depicts a wellbore including a packer consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 illustrates one embodiment of packer 100 for positioning downhole in a well to seal with either the interior surface of a borehole or an interior surface of a downhole tubular. During operation, packer 100 may be generally aligned with the central bore of wellbore 10 or the central bore of the tubular in the well when packer 100 may be lowered to the desired depth in the well.

Figure 2:
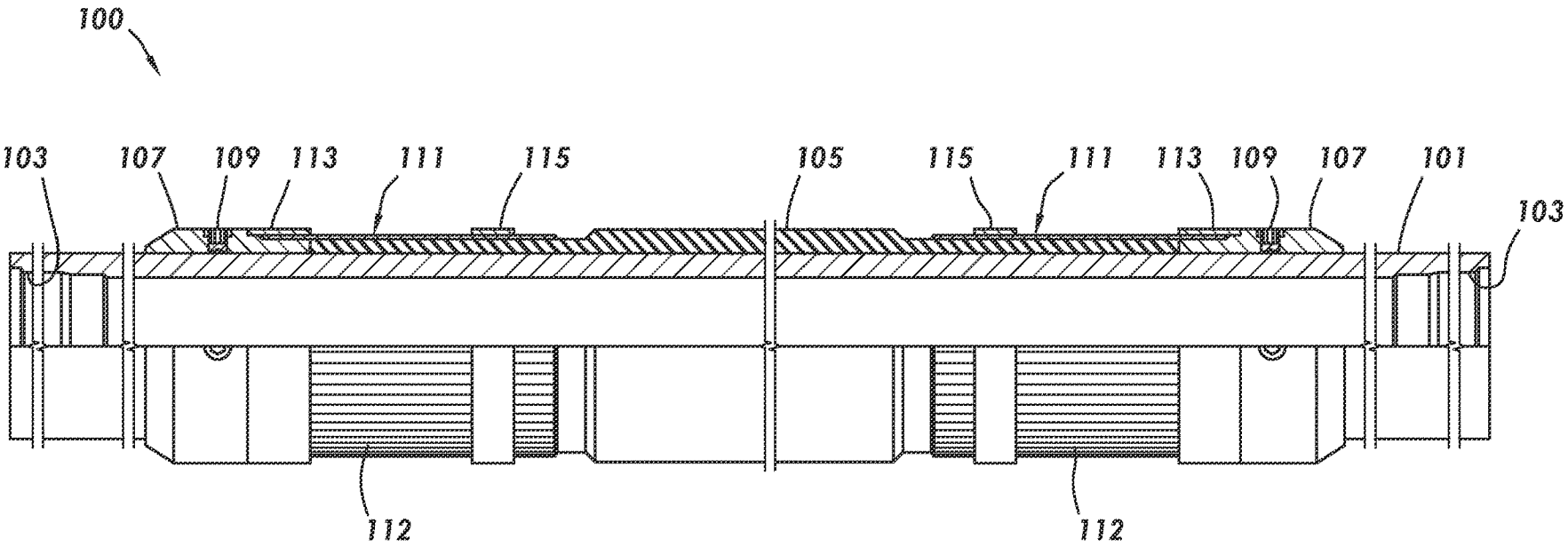
FIG. 2 depicts a partial cross-section view of a packer consistent with at least one embodiment of the present disclosure.

In some embodiments, as shown in FIG. 2, packer 100 may include mandrel 101. Mandrel 101 may be tubular and may include threaded connections 103 positioned to allow packer 100 to be included as a part of a downhole string. Packer 100 may include swellable elastomeric body 105, which may be positioned over the exterior surface of mandrel 101. In certain embodiments of the present disclosure, and as further described herein below, swellable elastomeric body 105 may be fixed to the outer diameter of mandrel 101 and formed by wrapped layers. In other embodiments, swellable elastomeric body 105 may be molded directly onto the outer diameter of mandrel 101. In some embodiments, swellable elastomeric body 105 may be bonded to mandrel 101 along the full length of swellable elastomeric body 105. In other embodiments, swellable elastomeric body 105 may be bonded to mandrel 101 along only a portion or portions of swellable elastomeric body 105. For example, in some embodiments, only a central portion of swellable elastomeric body 105 may be bonded to mandrel 101, while the rest of swellable elastomeric body 105 is positioned about mandrel 101 but is not bonded thereto. As another example, in some embodiments, one end of swellable elastomeric body 105 may be bonded to mandrel 101, while the rest of swellable elastomeric body 105 is positioned about mandrel 101 but is not bonded thereto.

Swellable elastomeric body 105 may be formed from an elastomeric material which swells in response to the absorption of a swelling fluid, generally an oil- or water-based fluid. The composition of the swelling fluid needed to activate packer 100 may be selected with consideration of the intended use of the packer. For example, a packer designed to pack off an area of a well at once may be either oil- or water-based and activated by a fluid pumped downhole. Alternatively, a delayed-use packer may be positioned in a well for long periods of time during, for example, hydrocarbon production. A swellable elastomeric body 105 which swells in response to an oil-based fluid would prematurely pack off the annulus. A swellable elastomeric body 105 which swells in response to water would therefore be used. Furthermore, one having ordinary skill in the art would understand that this selection can allow packer 100 to automatically activate in response to environmental phenomena. Such a packer could be used, for example, to provide automatic zonal isolation in response to production of water in an actively producing well.

In some embodiments, packer 100 may include end cap 107 positioned at one or both ends of packer 100. Each end cap 107 may be annular and may attach to the outer surface of mandrel 101 at an end of swellable elastomeric body 105. In some embodiments, end caps 107 may be held in place by anchor screws 109 that engage mandrel 101 once end caps 107 are positioned as desired.

In some embodiments, packer 100 may include backup mechanism 111. Backup mechanism 111 may be mechanically coupled to end caps 107. For example and without limitation, in some embodiments, backup mechanism 111 may include a plurality of slats 112, which may be held to end caps 107 by stress ring 113. In some embodiments, slats 112 may be welded to stress ring 113 or each other. Backup mechanism 111 may, for example and without limitation, provide metal-to-metal engagement between packer 100 and a surrounding tubular or to provide metal-to-rock engagement with an uncased wellbore. In some embodiments, backup mechanism 111 may be adapted to expand radially outward as the portion of swellable elastomeric body 105 between backup mechanism 111 and mandrel 101 expands and into engagement with the wellbore or surrounding tubular.

In some embodiments, slat bands 115 may be positioned about backup mechanism 111. Slat bands 115 may, for example and without limitation, maintain backup mechanism 111 in a neutral, i.e. non-expanded, position during run-in of packer 100, thereby reducing or preventing interference between backup mechanism 111 and the wellbore or surrounding tubular caused by bent or otherwise deflected backup mechanism 111. In some embodiments, slat bands 115 may be formed from swellable elastomeric material.

Figure 3:
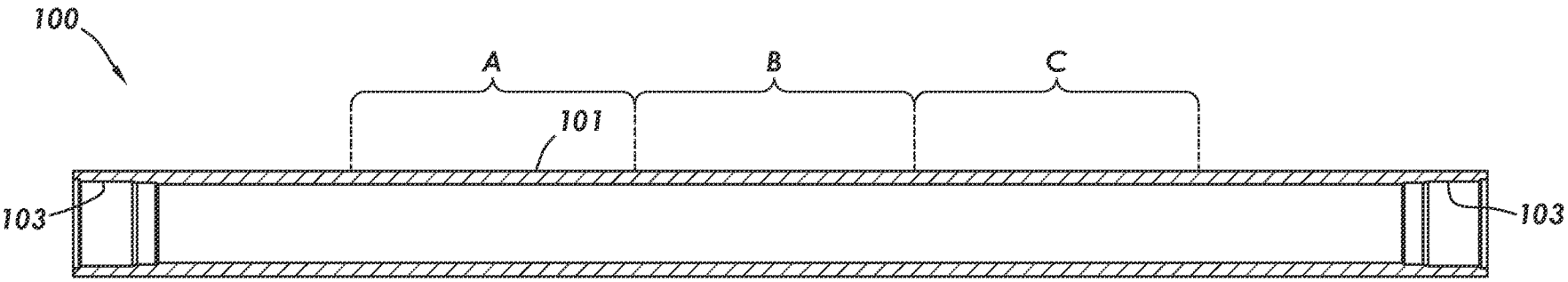
FIGS. 3-7 depict stages of forming a packer consistent with at least one embodiment of the present disclosure.

To form packer 100, mandrel 101 may be provided as shown in FIG. 3. Mandrel 101 may already have threaded connections 103 formed thereinto. A bonding agent may then be applied to portions of mandrel 101. In some embodiments, bonding agent may be applied across the entire surface to which swellable elastomeric body 105 is to be applied about mandrel 101, denoted by areas A, B, and C. In other embodiments, bonding agent may be applied to only a portion of the surface of mandrel 101 to which swellable elastomeric body 105 is to be applied. For example, in some embodiments, bonding agent may be applied at an area corresponding to the middle of swellable elastomeric body 105, denoted area B. In other embodiments, bonding agent may be applied only at one end of the surface of mandrel 101 to which swellable elastomeric body 105 is to be applied, such as only at area C. Areas A, B, and C are demonstrative only and are not intended to limit the scope of this disclosure or to imply any dimensions regarding bonded and unbonded areas between mandrel 101 and swellable elastomeric body 105.

Figure 4:
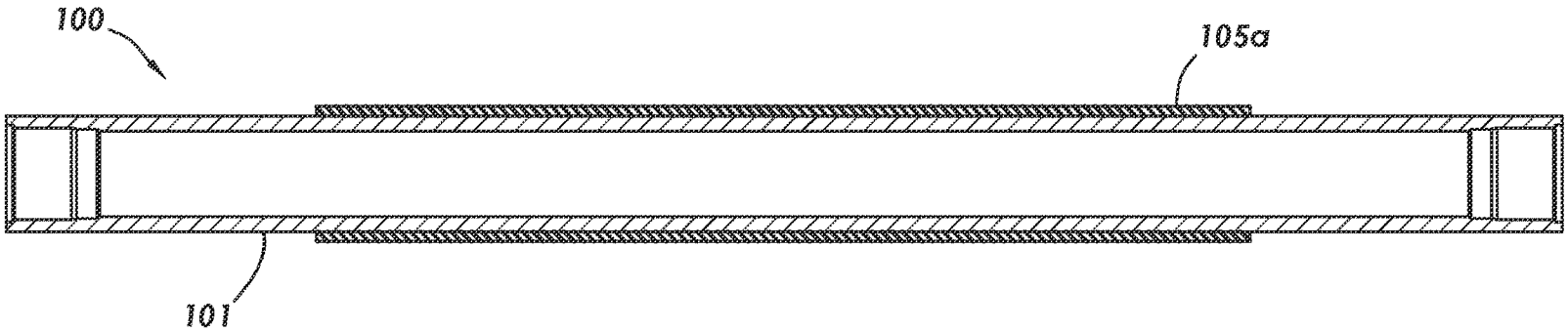

As shown in FIG. 4, swellable elastomer may then be applied to mandrel 101 to begin the formation of swellable elastomeric body 105. In some embodiments, swellable elastomer may be applied by wrapping the swellable elastomer about mandrel 101 or by molding the swellable elastomer to mandrel 101. In some embodiments, the swellable elastomer may be applied to mandrel 101 to an intermediate thickness, thus forming intermediate elastomeric body 105*a* as shown in FIG. 4. Intermediate elastomeric body 105*a* may be bonded to mandrel 101 at the locations at which bonding agent was applied to mandrel 101 as discussed above.

Figure 5:
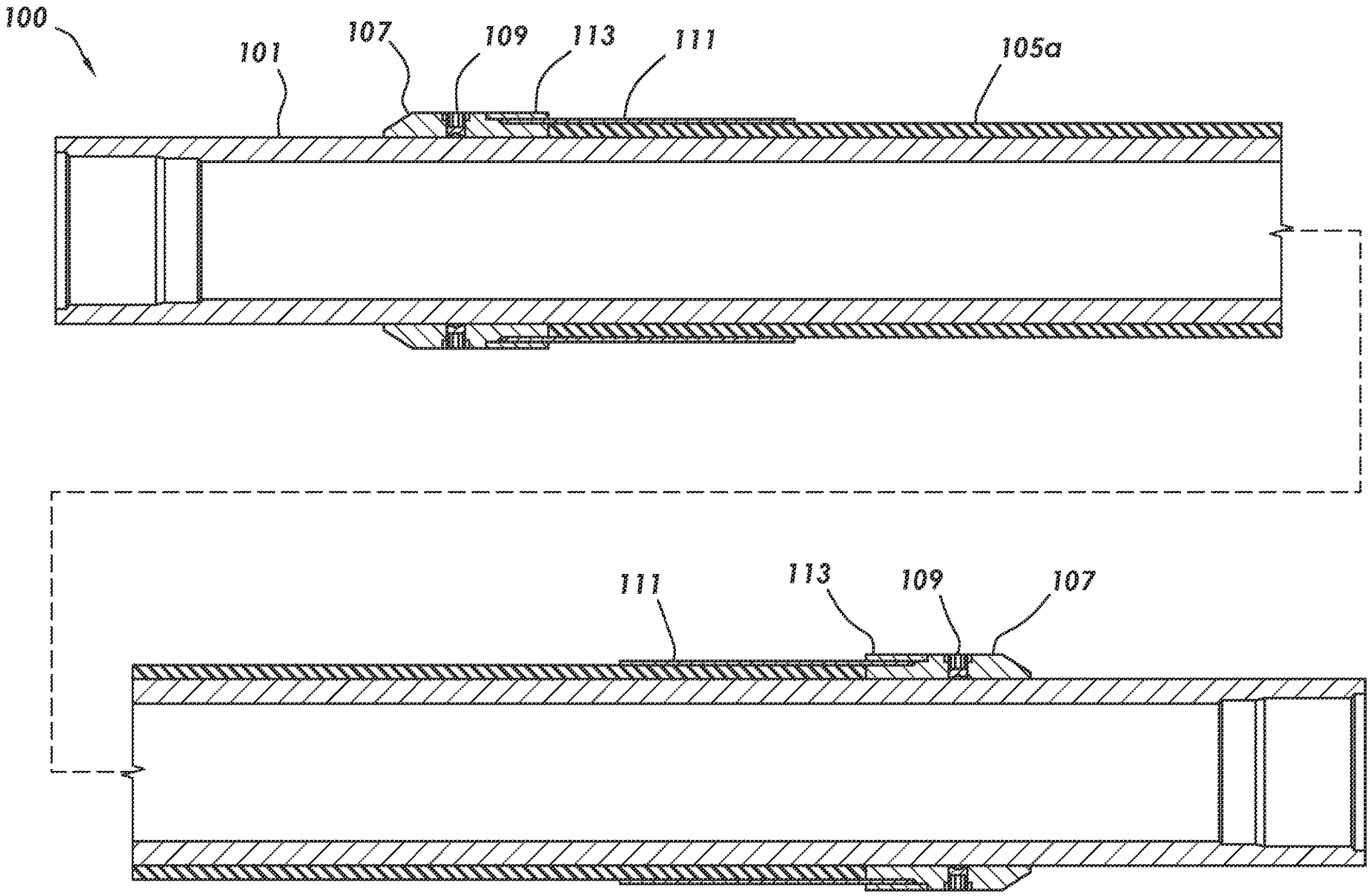

In some embodiments, end caps 107 and backup mechanism 111 may then be installed to mandrel 101 as shown in FIG. 5. Intermediate elastomeric body 105*a* may be formed to have an outer diameter corresponding substantially with the inner diameter of backup mechanism 111 such that backup mechanism 111 may slip around intermediate elastomeric body 105*a* during installation thereof. End caps 107 may be secured to mandrel 101 by tightening anchor screws 109.

Figure 6:
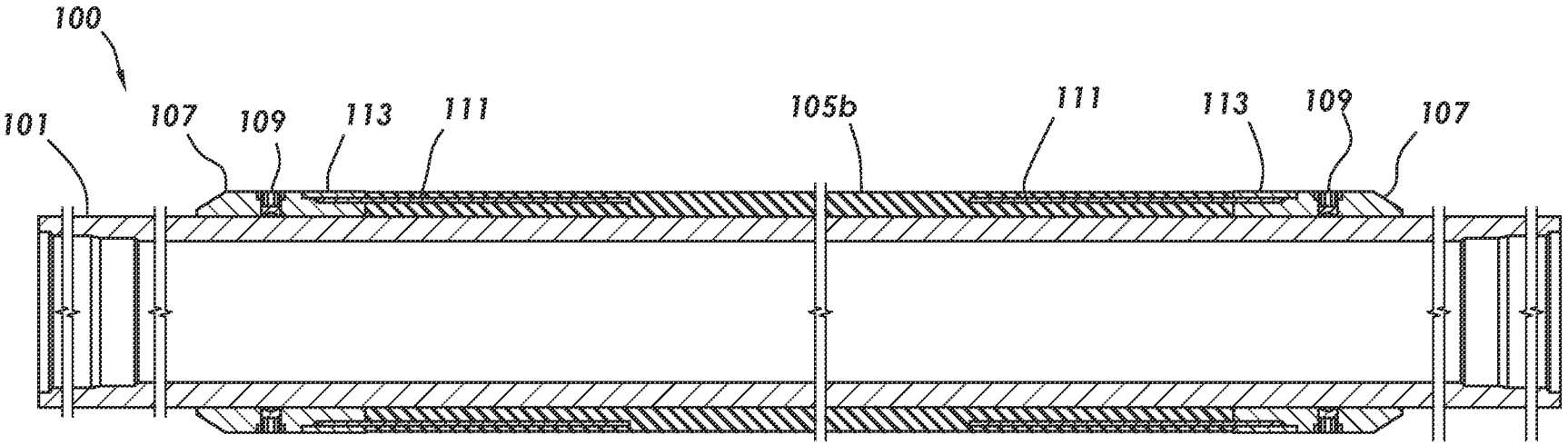

In some embodiments, additional swellable elastomer may be applied to mandrel 101 such that the additional swellable elastomer is positioned about backup mechanism 111 and intermediate elastomeric body 105*a*, together forming intermediate elastomeric body 105*b* as shown in FIG. 6. In some embodiments, the wrapping of additional swellable elastomer may continue until the external diameter of intermediate elastomeric body 105*b* corresponds with the desired outer diameter of packer 100.

Figure 7:
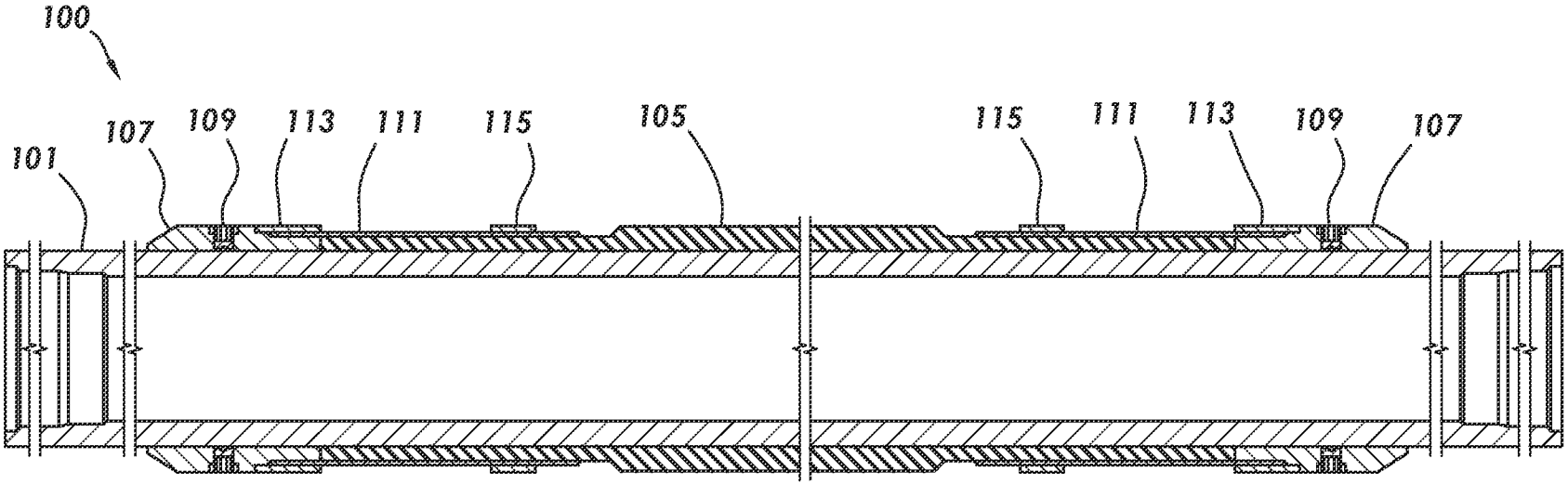

In some embodiments, a portion of intermediate elastomeric body 105*b* may be removed by, for example and without limitation, turning on a lathe, to form final swellable elastomeric body 105 as shown in FIG. 7. In some embodiments, swellable elastomer about backup mechanism 111 may be removed while leaving slat bands 115 in place. In some embodiments, slat bands 115 and a portion of swellable elastomeric body 105 between backup mechanism 111 may be kept at the desired outer diameter of packer 100. In other embodiments, all swellable elastomer about backup mechanism 111 may be removed.

In other embodiments, to form a space for backup mechanism 111 to be installed, a pocket forming tool may be applied over intermediate elastomeric body 105*a*, after which the additional swellable elastomer may be applied. Upon removal of the pocket forming tool and the elastomer applied thereto, a pocket is formed into which backup mechanism 111 may be installed.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A packer comprising:

a tubular mandrel;

a first end cap, the first end cap coupled to the mandrel;

a backup mechanism coupled to the first end cap;

a swellable elastomeric body positioned about the mandrel abutting the first end cap, the swellable elastomeric body positioned at least partially between the mandrel and the backup mechanism; and a band formed of swellable elastomeric material positioned radially outside the backup mechanism.

2. The packer of claim 1, wherein the band is positioned to cover part of, but not an entire outer surface of, the backup mechanism.

3. The packer of claim 1, wherein the swellable elastomeric body is formed by wrapped layers.

4. The packer of claim 1, wherein the swellable elastomeric body is at least partially bonded to the mandrel.

5. The packer of claim 4, wherein the swellable elastomeric body is bonded to the mandrel at a first end of the swellable elastomeric body but is unbonded to the mandrel at a second end of the swellable elastomeric body.

6. The packer of claim 4, wherein the swellable elastomeric body is bonded to the mandrel at a middle of the swellable elastomeric body but is unbonded to the mandrel at ends of the swellable elastomeric body.

7. The swellable packer of claim 1, wherein the swellable elastomeric body swells in response to contact with a swelling fluid, the swelling fluid being water-based or oil-based.

8. The packer of claim 1, wherein the backup mechanism comprises slats and a stress ring, the stress ring positioned radially about the slats.

9. A method comprising:

providing a mandrel, the mandrel being tubular;

applying a bonding agent to a portion of a surface of the mandrel;

applying swellable elastomer to the mandrel;

securing an end cap and backup mechanism to the mandrel, the end cap positioned at an end of the swellable elastomer, the backup mechanism extending along an outer surface of the swellable elastomer; and applying further swellable elastomeric material to the mandrel such that the further swellable elastomeric material is about the backup mechanism and the swellable elastomer already applied.

10. The method of claim 9, further comprising removing the further swellable elastomeric material from about at least part of the backup mechanism.

11. The method of claim 10, wherein the removing the further swellable elastomeric material from about at least part of the backup mechanism comprises turning off the further swellable elastomeric material in a lathe.

12. The method of claim 10, wherein the removing the further swellable elastomeric material comprises leaving a slat band of the further swellable elastomeric material about slats of the backup mechanism.

13. The method of claim 9, wherein the applying swellable elastomer comprises wrapping swellable elastomer.

14. The method of claim 9, wherein the applying the bonding agent is at a first end of the swellable elastomer, without applying bonding agent to the mandrel at a second end of the swellable elastomer.

15. The method of claim 9, wherein the applying the bonding agent is at a middle of the swellable elastomeric body, without applying the bonding agent to the mandrel at ends of the swellable elastomeric body.

* * * * *